US005365325A

United States Patent [19]

Kumasaka et al.

[11] Patent Number: 5,365,325

[45] Date of Patent: Nov. 15, 1994

[54] METHOD OF MULTI-COLOR RECORDING USING ELECTRO-PHOTOGRAPHY PROCESS AND APPARATUS THEREFOR WHEREIN MIXED COLORS GENERATION IS PREVENTED

[75] Inventors: Takao Kumasaka, Takahagi; Yuzuru Shimazaki; Toru Miyasaka, both of Hitachi; Yukio Otome, Katsuta, all of Japan

[73] Assignees: Hitachi, Ltd.; Hitachi Koki Co., Ltd., both of Tokyo, Japan

[21] Appl. No.: 102,360

[22] Filed: Aug. 5, 1993

[30] Foreign Application Priority Data

Aug. 10, 1992 [JP] Japan ..... 4-212874

[51] Int. Cl.[5] ..... G03G 15/01

[52] U.S. Cl. ..... 355/326; 355/208

[58] Field of Search ..... 355/326–328, 355/208, 219

[56] References Cited

U.S. PATENT DOCUMENTS

| | | | |
|---|---|---|---|
| 4,736,223 | 4/1988 | Suzuki . | |
| 4,791,452 | 12/1988 | Kasai et al. . | |
| 4,860,048 | 8/1989 | Itoh et al. | 355/326 X |
| 5,034,772 | 7/1991 | Suzuki | 355/326 X |
| 5,066,979 | 11/1991 | Goto et al. | 355/326 X |

FOREIGN PATENT DOCUMENTS 59-116763 7/1984 Japan .

*Primary Examiner*—R. L. Moses

*Attorney, Agent, or Firm*—Kenyon & Kenyon

[57] ABSTRACT

Each of a charging process on and after a second time is carried out by a charging means having a controlling electrode. The relationship between a controlling potential (Vg) applied to the controlling electrode of each charming means, the target surface potential (Vo) of a non-image portion of a surface of a photosensitive body and the direct current component potential (Vdc) of a developing bias potential in each developing process is satisfied by the formula, which is $|Vo| > |Vdc| \geqq |Vg|$. Thereby the corona current ia supplied to flow sufficiently, it can rise the surface potential of a toner image portion of the surface of the photosensitive body after the re-charming without the excessive rise of the surface potential of the non-image portion of the photosensitive body. The surface potential of the toner image portion of the photosensitive body after the re-charging becomes to higher than the direct component potential (Vdc) of the developing bias potential, it can prevent from mixing the toners having other color.

12 Claims, 9 Drawing Sheets

METHOD OF MULTI-COLOR RECORDING USING ELECTRO-PHOTOGRAPHY PROCESS AND APPARATUS THEREFOR WHEREIN MIXED COLORS GENERATION IS PREVENTED

BACKGROUND OF THE INVENTION

The present invention relates to method of multi-color recording using an electro-photography process and apparatuses therefor and, more particularly to a method of multi-color recording using an electro-photography process and an apparatus therefor in which, the second and successive charging processes after a second color image forming process are performed by using a recharging means with a controlling electrode.

In a prior art multi-color recording apparatus using an electro-photography process, in general the toner images having multiple colors are formed by overlapping the multiple colors on a surface of an endless type photosensitive body and the multi-color toners formed on the surface of the photosensitive body are transferred to a recording medium such as recording paper.

In the above stated prior art multi-color recording apparatus using the electro-photography process, the multiple image producing units are installed along a peripheral portion of a rotatable and cylindrically shaped photosensitive body.

One image producing unit of the multiple image producing units is formed with a set structure comprising a charging means, an exposing means and a developing means, for example.

Furthermore, a transferring means and a fixing means are arranged respectively at a rear position of the installing position of the final stage of the multiple image producing units.

In the above stated prior art multi-color recording apparatus using the electro-photography process, by using the mulitple image producing units, the toner images having the mulitple colors are formed on the surface of the photosensitive body. The toner images having the multiple colors are then transferred to the recording paper at a transferring portion. Next, by using the fixing means the toners are fused thermally and adhered to the recording paper. In this way, the multi-color recording printing method using the electro-photography process is carried out.

In addition, as a first treatment for the image production using the image producing units, the charging means for use in the charging process is constituted so as to charge uniformly the electric charges as much as possible on the surface of the photosensitive body.

Besides, the exposing means exposes selectively the electric charges on the surface of the photosensitive body in accordance with the recording contents (character, figure etc.). In the exposing means, by selectively erasing the electric charges on the surface of the photosensitive body, electro-static latent images are formed on the surface of the photosensitive body.

In addition, the developing means adheres the toners with the electro-static latent images which have been formed on the surface of the photosensitive body. Accordingly, the developing means forms the toner images on the surface of the photosensitive body.

Herein, it will be explained about the charging in the image producing process on and after the second color and on and after the second time. At a portion of the surface of the photosensitive body in which the toner images are formed by using the image producing unit of the prior stage, the toner image portion has a low surface potential (absolute value) in comparison with the surface potential of other areas (non-image portions) because in the toner image portion the electric charges are erased by the exposing process.

In the present invention, the toner image portion refers to the portion of the surface of the photosensitive body in which the toner images are formed, and the non-image portion refers to the portion of the surface of the photosensitive body to which the toners is not adhered and also a portion on which the toner images are not formed, respectively.

Accordingly, in the charging means of the image producing unit on and after second color (hereinafter, it is referred to as re-charging means in the present invention), it is desirable to uniformly charge the surface of the photosensitive body as much as possible, despite that the surface potential of the photosensitive body is not always uniform. Furthermore, it is desirable to increase the surface potential of the non-image portion to a predetermined target surface potential Vo.

In the prior art re-charging method, a scorotron type charging means with a controlling electrode (grid electrode) is employed as the re-charging means.

In this scorotron type charging means, the grid potential Vg is set substantially equal to the predetermined target surface potential Vo and in comparison with the non-image portion many corona discharging currents are made to flow into the exposing portion (the toner image portion) having the low surface potential, thereby making the surface potential of the photosensitive body uniform uniformly.

However, when a high speed (for example, 150~2000 mm/s) printing speed is attempted in the multi-color recording apparatus using the electro-photography process according to the prior art re-charging method, in the developing process of each image producing unit from the second color and thereafter, the problem occurs that the toners of the this time stage (the present stage) mix with the toner images that have been formed on the surface of the photosensitive body from the earlier stage.

Accordingly it is difficult to perform fine multi-color printing in the multi-color recording apparatus using the electro-photography process due to the mixed colors. In particular to ensure the proper toner image density of the present time stage, when the developing bias potential is high, it has a tendency to increase the mixed colors.

With respect to the cause of the mixed colors, the inventors of the present invention performed various experiments. As a result, the inventors have found the following points.

First, when operating at the high speed, it become the short time for charging by the re-charging means is short. Accordingly, before the electric charges are supplied sufficiently to the toner image portion of the surface of the photosensitive body as shown in FIG. 4B, the re-charging process has been completed using the prior art re-charging means.

Accordingly, the surface potential Vi of the toner image portion of the prior before stage (the surface potential Vb after the re-charging) does not rise sufficiently and is left at the condition of a large surface potential difference $\Delta Vb = |Vo - Vb|$ (difference between the surface potential Vo of the non-image portion (such as a background portion) after the re-charging and the surface potential Vb of the toner image portion of the after later stage).

If the large surface potential difference ΔVb is left as it is, the exposing process and the toner developing process of the current time stage is carried out.

As a result, the surface potential Vb of the toner image portion after the re-charging is lower than the direct current component potential Vdc of the developing bias potential. Accordingly the toners of the current time stage are mixed into the toner image portion of the prior before stage and causes the mixed colors.

As a method for preventing the mixed colors in combination with the above stated high speed printing in the multi-color recording apparatus using the electro-photography process, in the first place, by using a large size re-charging means it is possible to maintain sufficiently the charging time, however, this solution requires a large size multi-color recording apparatus.

The the technique about an improvement of the multi-color recording apparatus having a scorotron type charger as the charging means is shown in, for example Japanese patent laid-open No. 116,793/1984.

In the above Japanese patent laid-open publication, a charging process in the multi-color recording apparatus is proposed that applies the potential to the grid wires. This such applied potential has substantially the same potential value of the target charging potential and, the re-charging is carried out at the corona discharging area accompanying the light generation.

However, in the above stated charging process, in case of a negative corona discharge or in a case in which the corona wire or the grid wire is adhered by a dirty substance, then the light generation distribution becomes non-uniform and the potential after the re-charging has a tendency to become unstable.

Second, if the current capacity is increased in the scorotron type charging means used as the re-charging means, then the corona discharging current Ic is increased and the surface potential Vi of the toner image portion formed at the prior stage is increased sufficiently to increase the surface potential Vb of the toner image portion after the re-charging.

However, in a case in which it is desired to have the large electric capacity of the re-charging means and to increase the corona discharging electric Ic in the re-charging means, then the surface potential Vn of the non-image portion after the re-charging is made excessively high.

Accordingly, that it decreases the insulating property of the photosensitive body and the life of the photosensitive body is shortened. It also causes the black points on the photosensitive body or on the recording paper and lowers the developing property of small characters.

Also, in the above stated prior art multi-color recording apparatus using the electro-photography process, when the charging conditions are changed in concert with the change in the environmental conditions, the change in the surface conditions of the photosensitive body and the change in the dirty states of the re-charging means etc. due to the scattering of the toners, the quality of the multi-color printing material has a tendency to fluctuate.

SUMMARY OF THE INVENTION

An object of the present invention is to provide a method of a multi-color recording using an electro-photography process and an apparatus therefor wherein mixed colors can be prevented.

Another object of the present invention is to provide a method of a multi-color recording using an electro-photography process and a small size apparatus therefor wherein clear multi-color printing can be obtained.

A further object of the present invention is to provide a method of a multi-color recording using an electro-photography process and an apparatus therefor wherein a stable and high multi-color printing image quality can be obtained.

According to the present invention, a method of multi-color recording using an electro-photography process comprises an image producing process comprising a charging process for charging a photosensitive body; an exposing process for exposing selectively a surface of the charged photosensitive body in response to the recording content; and a developing process for adhering toners on the surface of the exposed photosensitive body; a transferring process for transferring the toner images on the surface of the photosensitive body to a recording medium, and a fixing means for fixing the toners to the recording medium.

By carrying out repeatedly in multiple times the image producing process, the toner images having mulitple colors are formed on the surface of the photosensitive body and thereby a multi-color recording method is carried out. Each of the charging processes for on and after the second color at least after the second time is carried out by a charging means with a controllable electrode.

The relationship between a controllable potential (Vg) applied to the controllable electrode of each charging means, the target surface potential Vo of the non-image portion of the surface of the photosensitive body and the direct current component potential (Vdc) of the developing bias potential in each of the developing process is satisfied according to the following formula (1).

$$|Vo| > |Vdc| \geqq |Vg| \quad (1)$$

According to the present invention, an apparatus of a multi-color recording using an electro-photography process comprises: an endless type rotatable photosensitive body, a multiple stage image producing units provided successively along a surrounding portion of the photosensitive body, a transferring means provided for corresponding with the surface of the photosensitive body of a rear side of a final stage of the image producing units, and the transferring means transfers the toner images on the surface of the photosensitive body to a recording medium, and a fixing means provided for corresponding with the surface of the photosensitive body of the rear side of the final stage of the image producing units, and the fixing means fixes the toners to the recording medium.

Each of the image producing units comprises a charging means for charging the electric charges on the photosensitive body, an exposing for forming the electro-static latent images according to expose selectively the electric charges charged by the charging means on the surface of the photosensitive body in response to the recording content, and developing means for adhering the toners on the electro-static latent images formed by the exposing means. Each of the image forming units has a controlling electrode for controlling the discharging current, respectively.

The relationship between a controlling potential (Vg) applied to the controlling electrode of the each charging means, the target surface potential Vo of the non-image portion of the surface of the photosensitive body and the direct current component potential (Vdc) of the developing bias potential in each the developing process is satisfied according to the above stated formula (1), which is $|Vo| > |Vdc| \geqq |Vg|$.

In addition, according to the present invention, the relationship between the controlling potential (Vg) applied to the controlling electrode of each of the charging means and the target surface potential (Vo) of a non-image portion of the surface of the photosensitive body is satisfied according to the following formula (2).

$$0.8|Vo| \geqq |Vg| \quad (2)$$

In each of the above stated formulae, it is preferable to set an absolute potential value $|Vg|$ of the surface potential of the controlling electrode more than an absolute potential value $|Vt|$ of the surface potential of the toner image portion before the re-charging so as to form the electric field necessary to flow the corona discharging current to the toner image portion of the surface of the photosensitive body.

It is desirable to overlap the direct current bias and the alternative current as the developing bias of the developing means.

According to the present invention, the multi-color recording apparatus using the electro-photography process further comprises: a potential detecting means for detecting the surface potential of the toner image portion and the surface of the non-image portion of the photosensitive body sent from each of the image producing units on and after the second stage; a memory means for storing a relationship formula between the controlling potential of the controlling voltage of the charging means of the image producing unit on and after the second stage and the discharging current; and a controlling means for setting the controlling potential and the discharging current of the image producing unit from the second stage and thereafter in accordance with the detected surface potential of the toner image portion and the detected surface potential of the non-image portion and the relationship formula.

First of all, the principle of the re-charging according to the present invention will be explained as follows:

The inventors of the present invention have carried out various experiments with respect to the re-charging using the scorotron type charging means. As a result, they found out that the relationship between the controlling potential Vg applied to the controlling electrode of each of the charging means, the target surface potential Vo of the non-image portion of the photosensitive body and the direct current component potential Vdc of the developing bias potential in each the developing process is satisfied according to the above stated formulae (1) or (2).

When the above stated relationship is satisfied, the inventors of the present invention discovered that the surface potential Vi of the toner image portion after re-charging becomes nearly equal to the target surface potential Vo of the non-image portion, the surface potential difference $\Delta V = |Vo - Vi|$ is reduced, and that one can increase the surface potential Vi of the toner image portion after re-charging above the direct current component potential Vdc of the developing bias potential.

The above stated principle and phenomena about the re-charging in the present invention will be explained referring to the drawing.

FIG. 2 is a schematic view showing the arrangement relationship of the photosensitive body and the scorotron type re-charging means. In FIG. 2, the surface of the photosensitive body 1 is formed by the dielectric member. The back face of the photosensitive body 1 is earthen and the photosensitive body 1 is moved in a direction as shown in FIG. 2.

The scotorton type re-charging means 5 is arranged in opposition to the surface of the photosensitive body 1. The re-charging means 5 comprises a cover 5*a*, discharging wires 5*b* disposed in an interior portion of the cover 5*a* and a grid electrode 5*c* arranged between the discharging wires 5*b* and the surface of the photosensitive body 1.

With the discharging wires 5*b* and the grid electrode 5*c* the direct current voltage is applied from the variable direct current power sources 13 and 14, and the corona discharging current Ic generates from the discharging wires 5*b*. This corona discharging current Ic is split into the current Id flowing through the photosensitive body 1 and the current Ig flowing through the grid electrode 5*c*.

Using the re-charging means 5 constructed above, the grid potential (control potential) Vg, the corona discharging current Ic and the surface potential Vn of the non-image portion and the surface potential Vi of the toner image portion have measured by experimentation.

FIG. 4A shows the result of the re-charging method which satisfies the relationship (the formula, namely, $|Vo| > |Vdc| \geqq |Vg|$) according to the present invention. FIG. 4B shows the result of the re-charging method according to the prior art.

According to the prior art re-charging method, when the grid potential Vg is set substantially equal to the predetermined target surface potential Vo, both the surface potential Vn of the non-image portion of the before stage and the surface potential Vi of the toner image portion of the before stage increased at a large rate with increasing corona discharging current Ic of the re-charging as shown in FIG. 4B.

Accordingly, in the prior art multi-color recording apparatus using an electro-photography process, so as to not to highly exceed the surface potential Vn of the non-image portion when it is set to the target surface potential Vo, it is necessary to restrain the corona discharging current Ic.

Before the surface potential Vi of the toner image portion of the before stage is increased sufficiently, and the surface potential Vn of the non-image portion reaches the target surface potential Vo, the surface potential difference ΔVb is enlarged.

Accordingly, in the prior art multi-color recording apparatus using the electro-photography process, the surface potential Vi of the toner image portion is not increased sufficiently and further when the surface potential Vi of the toner image portion is decreased below the direct current component potential Vdc of the developing bias potential, it causes the phenomenon that at the next developing process the toners having the other colors mix into the toner image portion and thus mixed colors occur.

The phenomenon into which the toners having the other colors mix into the toner image portion shown in the prior art will be explained referring to FIG. 5A and FIG. 5B.

FIG. 5A and FIG. 5B are explanatory views showing schematically the change of the surface distribution at each portion of the photosensitive body during the re-charging process. FIG. 5A is an explanatory view showing the case in which by applying the prior art re-charging method it merely it makes at the high speed, and FIG. 5B is an explanatory view showing the case in which merely by increasing the corona discharging current Ic the surface potential Vi of the toner image portion is increased.

In FIGS. 5A and 5B, the references C1, L1 and D1 indicate the charging process, the exposing process and the developing process of the first color, respectively, and the references C2, L2 and D2 indicate the charging process, the exposing process and the developing process of the second color, respectively.

First of all, as shown in FIG. 5B, merely when the corona discharging current Ic is increased and it heightens the surface potential $Vi_1$ of the toner image portion of the first color, the surface potential $Vn_1$ of the non-image portion of the first color largely exceeds the target surface potential Vo.

When the surface potential $Vn_1$ of the non-image portion of the first color becomes highly excessive, the life of the photosensitive body becomes shorter and the developing property of the small characters is damaged.

So as to avoid the above stated problems, when the surface potential $Vn_1$ of the non-image portion of the first color is restrained at the target surface potential Vo, as shown in FIG. 5A, in the re-charging process C2 of the second color the surface potential $Vi_1$ of the toner image portion of the first color is not raised sufficiently and thereby it remains in the state in which the potential difference $\Delta Vb$ between the potential $Vi_1$ of the toner image portion of the first color and the surface potential $Vn_1$ of the non-image portion of the first color remains the large Accordingly, the surface potential $Vi_1$ of the toner image portion of the first color becomes lower than the direct current component potential Vdc of the developing bias potential of the second color. As a result, as shown in FIG. 5A, the toners of the second color mix into the toner image portion of the first color.

As shown in the above relationship (the above stated formula (1) or (2)), when the grid potential Vg is set to much lower than the target surface potential Vo, the relationship between the corona discharging current Ic and the surface potential of the photosensitive body becomes as shown in FIG. 4A.

Namely, the surface potential Vn of the non-image portion is raised gradually against the increase in the corona discharging current Ic of the re-charging, and the surface potential Vi of the toner image portion formed in the prior stage is raised significantly compared with an increase in the surface potential Vn of the non-image portion.

As a result, one can significantly increase the corona discharging current Ic and, the surface potential Vn of the non-image portion can be restrained at the target surface potential Vo.

Furthermore, the surface potential Vi of the toner image portion can be raised to the target surface potential Vi* and the surface potential difference $\Delta V$ between the surface potential Vi of the toner image portion and the surface potential Vn of the non-image portion can be decreased.

FIG. 6 is an explanatory view showing schematically the change of the surface distribution at each portion of the photosensitive body during the re-charging process according to the present invention.

As clearly shown in FIG. 6, in each process C2, L2 and D2, the surface potential $Vi_1$ of the toner image portion of the first color can increase fully, and the potential difference $\Delta V$ can decrease. Accordingly, the surface potential $Vi_1$ of the toner image portion of the first color can be larger than the direct current component potential Vdc of the developing bias potential of the second color.

Accordingly, this can prevent the phenomenon shown in FIG. 5A in which in the second color developing process D2 the toners of the second color mix into the toner image portion of the first color.

To sum up, according to the present invention, since the grid potential Vg of the re-charging means of the current time stage is made lower than the direct current component potential Vdc of the developing bias potential of the current time stage, and since the grid potential Vg of the re-charging means of the current time stage is made much smaller than the target surface potential Vo, for example $|Vg| \leqq 0.8|Vo|$, the surface potential $Vi_1$ of the toner image portion of the first color can be made higher than the direct current component potential Vdc of the developing bias potential.

Accordingly, this can prevent mixing of the toners of a color in the current time stage into the toner image portion of the first color formed in the prior stage.

According to the present invention, even when printing the multi-color at the high speed, the re-charging is carried out using the small size re-charging means. Thus, the present invention prevents the generation of the mixed colors and accordingly clear printing of images is possible.

According to the present invention, the surface potential Vi of the toner image portion of the photosensitive body and the surface potential Vn of the non-image portion of the photosensitive body which is sent to each image producing unit on and after the second stage are detected.

In accordance with this detected surface potential at each portion and the relationship, such as $|Vg| \leqq 0.8|Vo|$, since the grid potential and the corona discharging current and the developing bias potential are controlled, as a result the present invention can prevent the fluctuation in quality of the multi-color printing material accompanying a change in the environment condition and the surface state of the photosensitive body.

Figure 1:
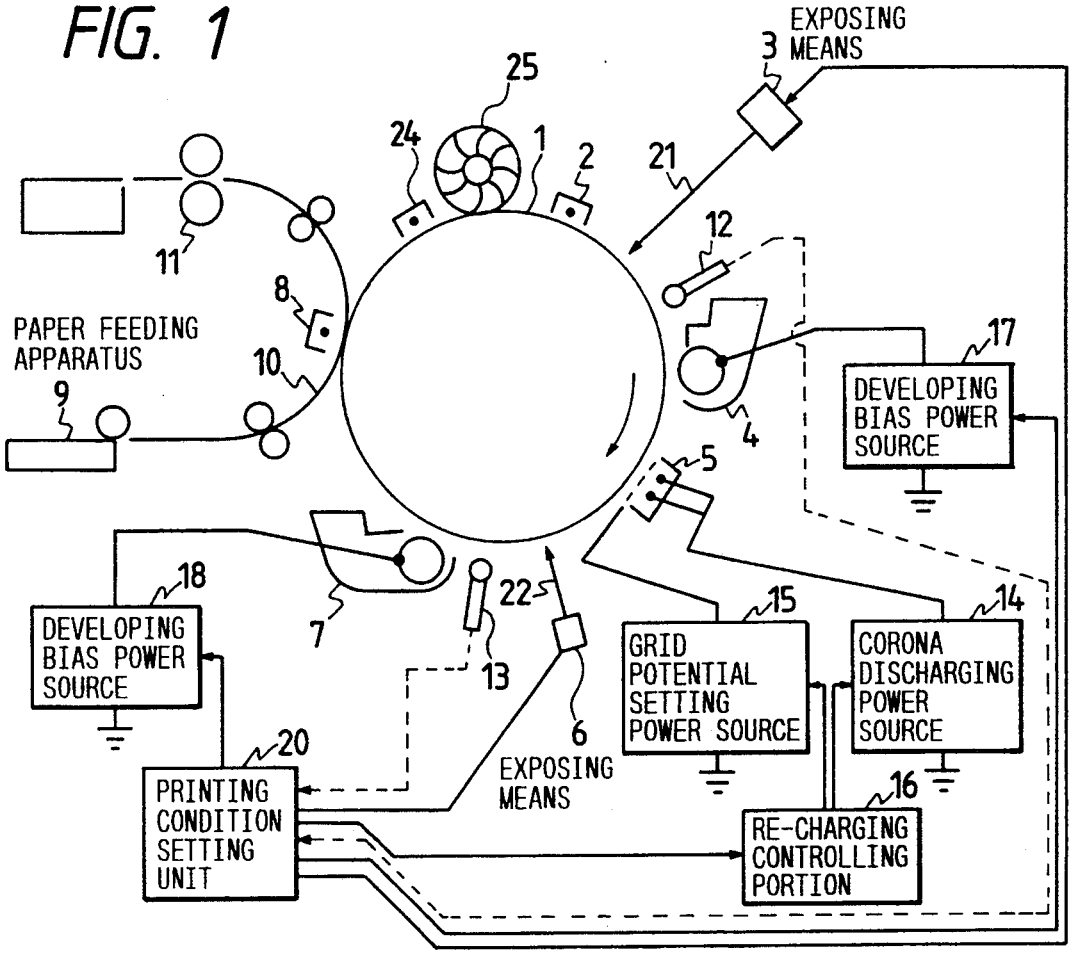
FIG. 1 is a schematical view showing one embodiment of a multi-color recording apparatus using an electro-photography process according to the present invention.

DESCRIPTION OF THE INVENTION:

One embodiment of a method of a multi-color recording using an electro-photography process and an apparatus therefor according to the present invention will be explained referring to the drawings.

Figure 2:
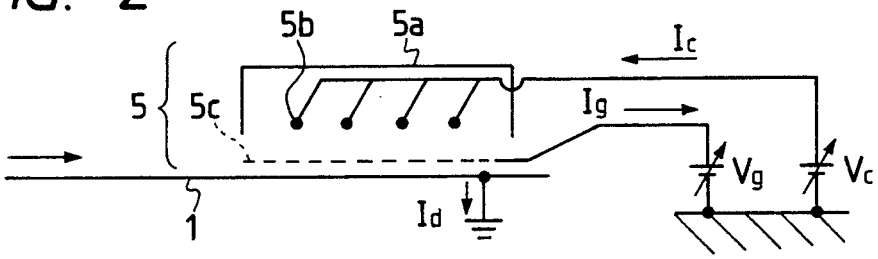
FIG. 2 is a schematical view explaining the construction and a motion of a re-charging means of a multi-color recording apparatus using an electro-photography process according to the present invention.
Figure 3:
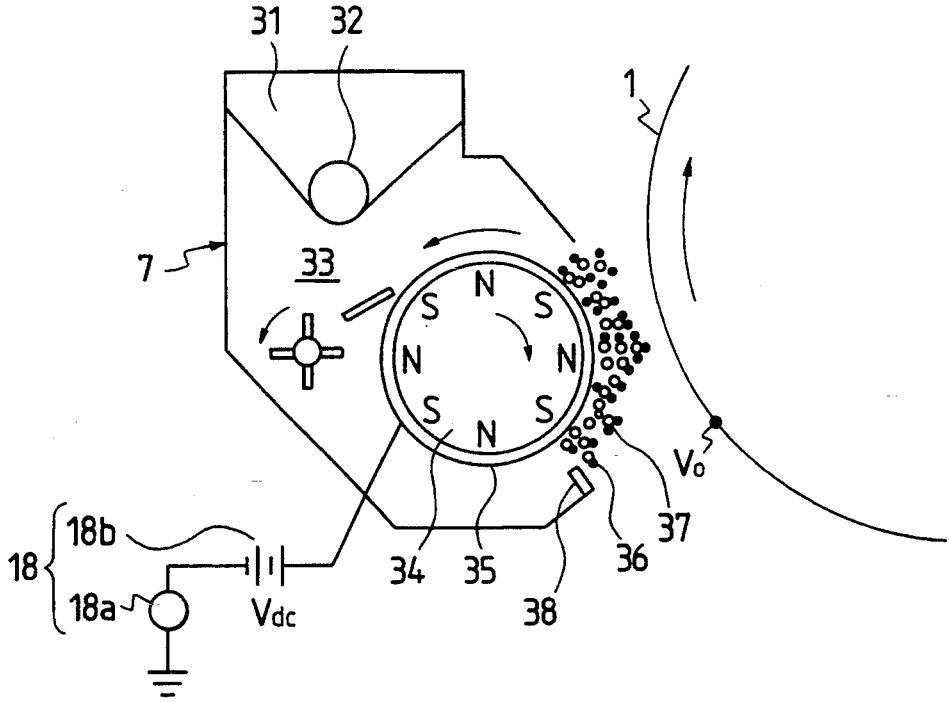
FIG. 3 is a schematical view explaining the construction and the motion of a developing means of a multi-color recording apparatus using an electro-photography process according to the present invention.

FIG. 1 is a schematical view showing one embodiment of a multi-color recording apparatus using an electro-photography process according to the present invention. FIG. 2 is a schematical view explaining the construction and the motion of a re-charging means of the multi-color recording apparatus using the electro-photography process, and FIG. 3 is a schematical view explaining the construction and the motion of a developing means of the multi-color recording apparatus using the electro-photography process.

As shown in FIG. 1, one embodiment of the multi-color recording apparatus using the electro-photography process according to the present invention is given showing an example of a two-color recording apparatus using an electro-photography process.

In the two-color recording apparatus using the electro-photography process, the two-color recording is carried out while an endless type photosensitive body 1 of the two-color recording apparatus rotates at one rotation.

This endless type photosensitive body 1 of the two-color recording apparatus is made of a cylindrical electric conductor body and a photo-conductive layer formed on the electric conductor body. The photosensitive body 1 is formed rotatively in a direction as shown by the arrow in FIG. 1. The inner face of the photosensitive body 1 is at ground potential.

In the two-color recording apparatus, along a peripheral direction of this photosensitive body 1, a charging means 2, an exposing means 3 and a developing means 4 are arranged in order.

An image producing unit for a first color is formed by the first color charging means 2, the first color exposing means 3 and the first color developing means 4.

At a rear side along the peripheral direction of the photosensitive body 1, a re-charging means 5, an exposing means 6 and a developing means 7 are arranged in order.

An image producing unit for a second color is formed by the second color re-charging means 5, the second color exposing means 6 and the second color developing means 7.

At a rear side along the peripheral direction of this photosensitive body 1, a transferring means 8 is disposed. A recording paper 10 as a recording medium from a recording paper feeding apparatus 9 is supplied to this transferring means 8. The recording paper 10 passed through the transferring means 8 is discharged through a fixing means 11.

A surface potentiometer 12 for detecting the surface potential of the photosensitive body 1 is provided in a position just before the installing position of the first color developing means 4. A surface potentiometer 13 for detecting the surface potential of the photosensitive body 1 is provided on a position just before the installing position of the second color developing means 7.

As the re-charging means 5, a scorotron type charging means having the construction shown in FIG. 2 is adopted. Further, in this re-charging means 5, a power source 14 for discharging the corona, a power source 15 for setting the grid potential and a re-charge controlling unit 16 for controlling output values of the corona discharging power source 14 and the grid potential setting power source 15 are provided.

A developing bias power source 17 is provided in the first color developing means 4 and further a developing bias power source 18 is provided in the second color developing means 7, respectively.

Surface potential detecting signals of the surface potentiometer 12 and 13 are input into a printing condition setting portion 20 and stored in a memory means of the printing condition setting portion 20. The printing condition setting portion 20 performs to a setting of the re-charging condition, a setting of the developing bias condition for the first color and the second color.

In accordance with the contents of the setting, the first color exposing means 3 and the second color exposing means 6, the re-charge controlling portion 16 and the developing bias power sources 17 and 18 are controlled, respectively.

Next, the detailed constructions of the above embodiment according to the present invention will be explained in concert with the motions.

The features of the above embodiment of the multi-color recording apparatus using the electro-photography process according to the present invention reside in that respective potential relationship is set to satisfy the following formula (1*a*).

Namely, the relationship between the grid potential Vg (v) of the scorotron type re-charging means 5, the surface potential Vn (v) of the non-image portion before the re-charging (the before stage), the target potential value Vo (v) of the surface potential after the re-charging (current time stage), the direct current component potential Vdc (v) of the developing bias potential of the developing means carried out after the re-charging (current time stage) and the surface potential Vt of the toner image portion before the re-charging is set to satisfy the following formula (1*a*).

$$|Vo| > |Vdc| \geqq |Vg| > |Vt| \quad (1a)$$

In particularly, it is desirable to set the grid potential Vg as shown in next formula (2*a*) and to carry out the re-charging. Namely, it is desirable to set the grid surface potential Vg lower by more than 0.2 Vo (v) than the target surface potential Vo of the re-charging (the second time) and to carry out the re-charging.

$$0.8|Vo| \geqq |Vg| > |Vt| \quad (2a)$$

Figure 4A:
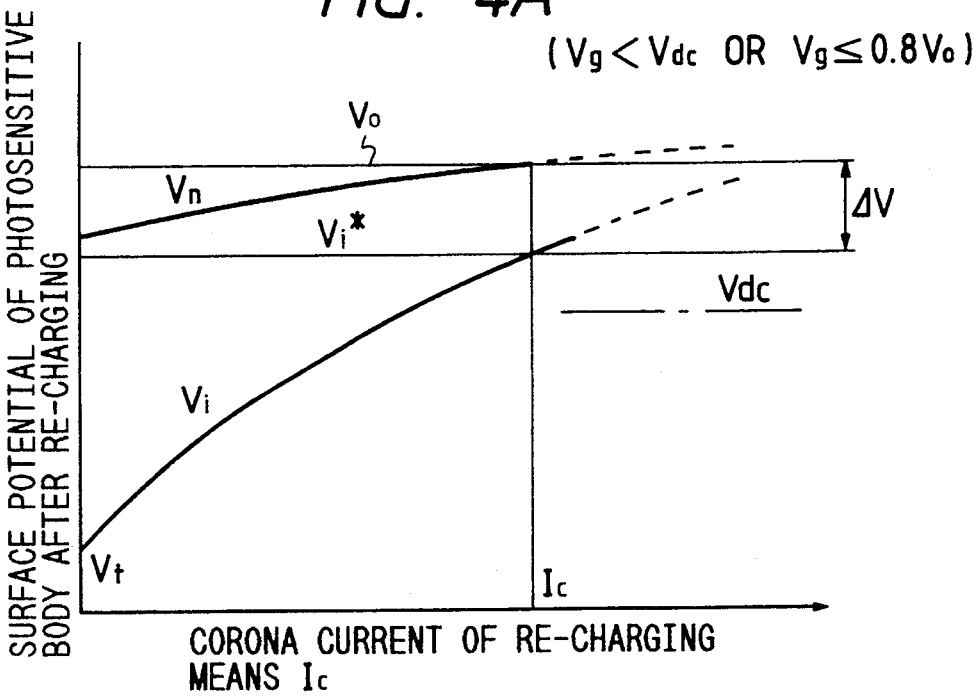
FIG. 4A is a graph showing the relationship between the corona current of a re-charging means and a surface potential of a photosensitive body according to the present invention.
Figure 4B:
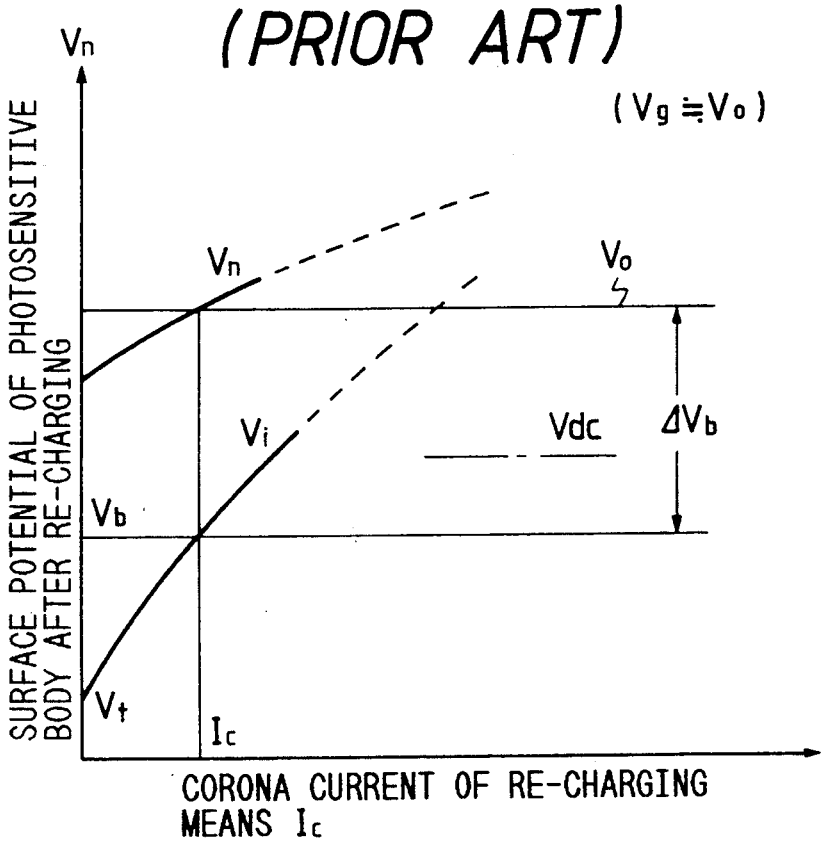
FIG. 4B (PRIOR ART)
FIG. 4B is a graph showing the relationship between the corona current of a re-charging means and the surface potential of a photosensitive body according to the prior art.

The surface potential of the respective portions at an inlet portion of the re-charging means 5 corresponds to a case in which the corona current Ic shown in FIG. 4A is zero.

Relative to the surface potential Vn of the non-image portion of the first color, in the first color toner image portion which is formed in the first color image producing process, the surface potential Vi becomes low because the electric charges are erased by the exposing process since to the surface potential of the toner image portion of the first color is substantially equal to the surface potential Vt of the toner image portion before the re-charging.

From the above stated condition, when the toner image portion is moved to an installing position of the re-charging means 5, since the surface potential Vn of the non-image portion of the first color is higher than the grid potential Vg of the scorotron type charging means, even when the corona current Ic is increased, the surface potential Vn of the non-image portion of the first color is barely raised. In other words, the increasing rate of the surface potential Vn of the non-image portion of the first color is small.

Since the surface potential Vi of the toner image portion of the first color is lower than the grid potential Vg, the surface potential Vi of the first color toner image portion is increased significantly in concert an increase in the corona current Ic. In other words, the increasing rate of the surface potential Vi of the first color toner image portion is large.

Accordingly, as shown In FIG. 4A, as the surface potential Vi of the first color toner image portion is raised by increasing the corona current Ic, the surface potential Vn of the non-image portion of the first color is prevented from becoming exceedingly large.

Figure 5A:
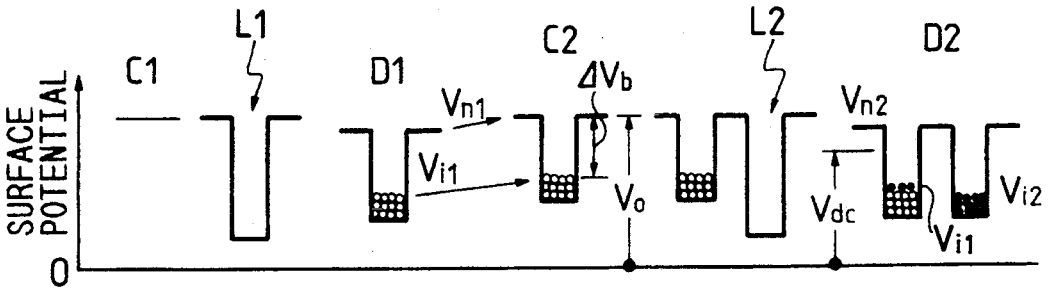
FIG. 5A (PRIOR ART)
FIG. 5A is an explanatory view showing the potential distribution change of each portion explaining the cause for mixed colors.
Figure 5B:
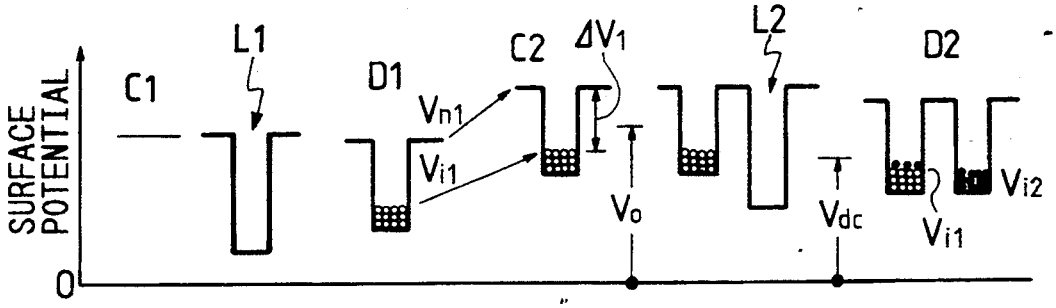
FIG. 5B (PRIOR ART)
FIG. 5B is an explanatory view showing the potential distribution change of each portion explaining the problem when the corona current is increased merely to prevent mixed colors.

As a result, the potential difference ΔV between the surface potential Vn of the first color non-image portion after the recharge and the surface potential Vi of the first color toner image portion is made remarkably smaller than the surface potential difference ΔVb in the prior art shown in FIG. 5B.

Figure 6:
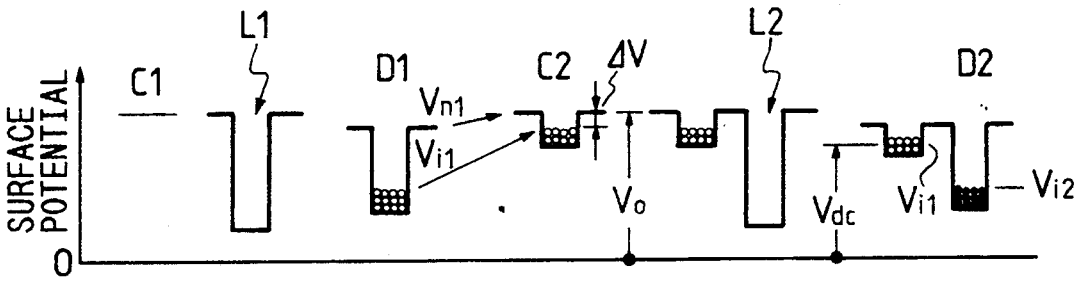
FIG. 6 is an explanatory view showing a potential distribution change of each portion explaining that mixed colors can be prevented by a re-charging means according to the present invention.

Smaller than shown in FIG. 6, since the surface potential Vi of the first color toner image portion is made higher than the direct current component potential Vdc of the second color developing bias potential, mixed colors caused by mixing the toners of the second color into the toner image portion of the first color can be prevented.

As shown in the second color developing means 7, i.e., the developing means after the second color, it is desirable to prevent the disturbance of the toner image formed in the prior stage and the occurrence of the mixed colors. From the above stated views, it is preferable to adopt a non-contact developing method or a soft developing method in which the developing means softly contacts to the photosensitive body 1.

A schematic view showing one example of the non-contact type developing means 7 of the second color will be explained referring to FIG. 3.

As shown in FIG. 3, the toners stored in a toner reservoir 31 are supplied into a hopper 33 by a toner feeder 32. In the hopper 33, a cylindrical magnet roll 34 is disposed in parallel to a cylindrical shaft of the photosensitive body 1. On a surface of the magnet roll 34, a developing sleeve 35 is provided. From a developing bias power source 18, a bias potential overlapping the alternating current component potential Vac and the direct current component potential Vdc is applied.

The developing bias power source 18 connects in series an alternating current power source 18*a* and a direct current power source 18*b*.

The developing sleeve 35 rotates in the same direction of rotation as the photosensitive body 1, however, the magnet roll 34 rotates in the reverse direction. On the surface of the rotatable developing sleeve 34, the developing agent (developer) which is comprised of the toners 36 and the carriers 37 stored in the hopper 33, is transferred to the developing portion. The thickness of the developing agent is regulated by a doctor plate 38.

The direct current component potential Vdc (v) of the developing bias potential of the developing means 7 is set under the consideration about a range in which the photographic fog in the ground or the base does not occur in the non-image portion, because the contrast potential for the development is large.

The direct current component potential Vdc is set according to formula (3) with respect to the target potential value Vo (v) of the surface potential after the re-charging.

$$200 \geqq |Vo - Vdc| \geqq 50 \quad (3)$$

Herein, when the conditions shown in formulae (2*a*) and (3) are satisfied, formula (1*a*) is met. Namely, in accordance with formula (2*a*) and formula (3) the re-charging condition and the developing bias condition of the second color are set.

Herein, with respect to an example for the controlling method of the re-charging which is another feature of the present invention, it will be explained referring to the control process flow-chart of the re-charging controlling unit 16 shown in FIG. 1 and from FIG. 7 to FIG. 9. In the above stated example, the first color developing and the second color developing employ the reversal developing method, respectively.

The re-charging control comprises steps having a first step, a second step and a third step. The first step, the second step and the third step of the re-charging control corresponds to FIG. 7, FIG. 8 and FIG. 9, respectively.

(1) The first step

Figure 7:
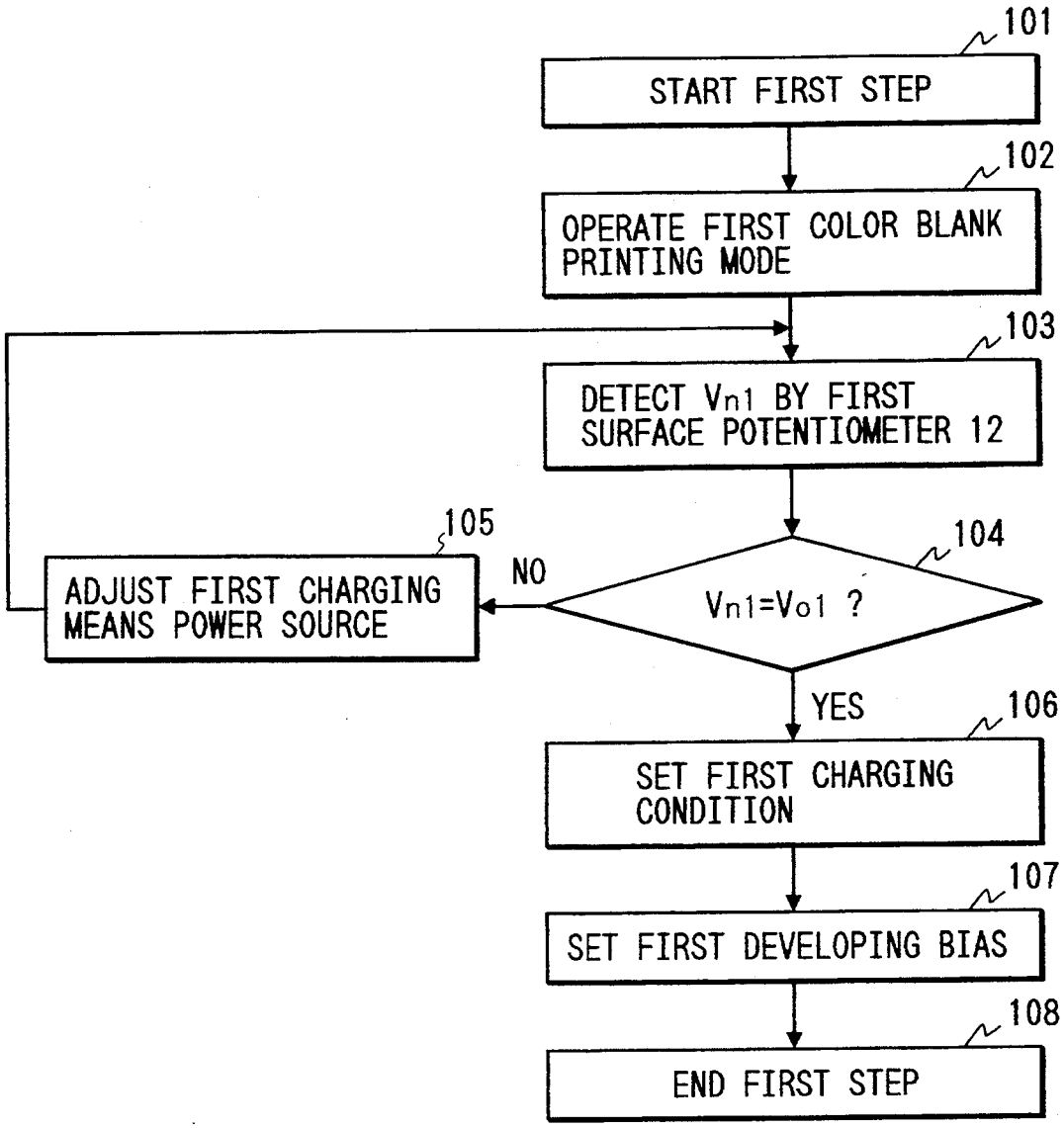
FIG. 7 is a flow-chart showing a first controlling procedure with respect to a re-charging control which is another feature of the embodiment shown in FIG. 1 according to the present invention.

As shown in FIG. 7, the first step comprises steps from step 101 to step 108. This first step is a process for setting or controlling the surface potential of the non-image portion of the first color.

First, the printing condition setting portion 20 sends a signal with respect to the printing pattern suitable for carrying out the control processing of the first step to the first color exposing means 3 and this printing condition setting portion 20 controls the first color exposing condition.

As a result, through the printing condition setting portion 20, from the first color exposing means 3 the exposing light 21 in response to the printing pattern is irradiated on the surface of the photosensitive body 1.

So as to detect the surface potential Vn of the non-image portion of the first color, it is preferable to make the whole recording paper at the non-exposing state, for example. For carrying out the first color developing if the reversal developing method is used, the printing pattern is set at the blank printing mode.

The first surface potentiometer 12 detects the surface potential Vn of the non-image portion at the position just before the installing position of the first color developing means 4 and the detected signal is sent into the memory of the printing condition setting portion 20.

Herein, it is possible to omit the first surface potentiometer 12 and use the second surface potentiometer 13 to serve as both .

In this printing condition setting portion 20, the detected surface potential $Vn_1$ is compared with the target potential value $Vo_1$ and the power source of the first color charging means 2 is controlled so as far the detected surface potential $Vn_1$ agrees with the target potential value $Vo_1$. After that in accordance with the surface potential $Vn_1$, the first color developing bias power source 17 is controlled.

It is possible to use this control processing both during the monochrome printing of the first color and during the two color printing.

The second image producing unit carries out similarly the above stated processing. Namely, the second surface potentiometer 13 detects the surface potential $Vn_2$ of the non-image portion at the position just before the installing position of the second color developing means 7 and the detected signal is sent into the memory of the printing condition setting portion 20.

In this printing condition setting portion 20, the detected surface potential $Vn_2$ is compared with the target potential value to determine whether the detected surface potential Vn agrees with the target potential value. The power sources 14 and 15 of the scorotron type re-charging means 5 are controlled through the re-charging controlling unit 16. After that in accordance with the surface potential $Vn_2$ the first color developing bias power source 18 is controlled.

The printing condition setting portion 20 sends the signal with respect to the printing pattern suitable for carrying out the control processing of the first step to the first color exposing means 3 and the second color exposing means 6. This printing condition setting portion 20 controls the first color exposing condition and the second color exposing condition.

Since the surface potential $Vn_2$ of the non-image portion is detected after the first color image producing processing at the position just before the installing position of the second color developing means 7, the surface potential $Vn_1$ of the first color non-image portion after re-charging has a different potential value from that of the surface potential $Vi_1$ of the toner image portion.

(2) The second step

Figure 8:
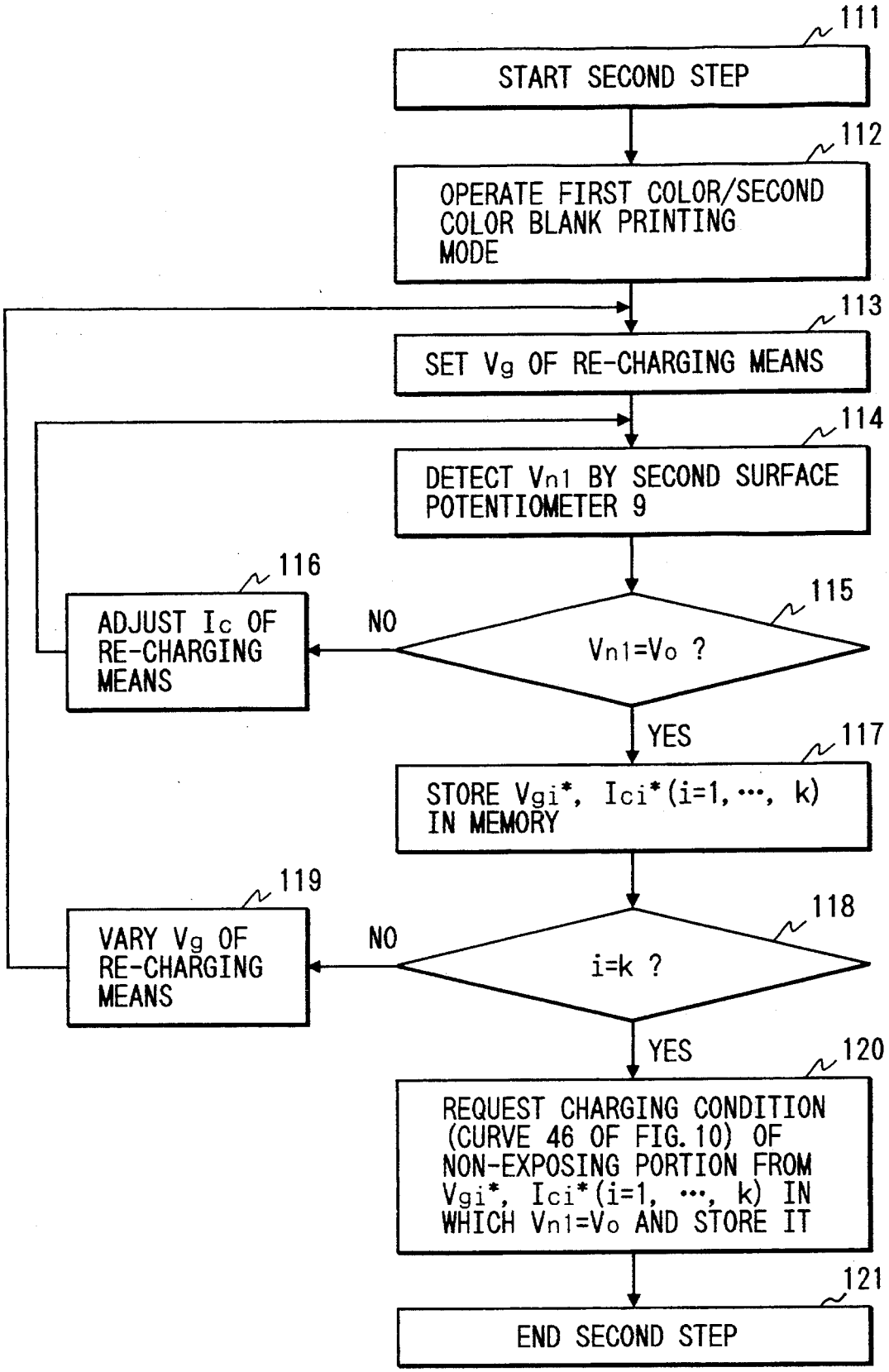
FIG. 8 is a flow-chart showing a second controlling procedure with respect to the re-charging control which is another feature of the embodiment shown in FIG. 1 according to the present invention.

As shown in FIG. 8, the second step comprises the steps from step 111 to step 121. This second step detects the surface potential $Vn_1$ of the first color non-image portion within the surface potential of the second color non-image portion after re-charging and controls the detected surface potential $Vn_1$ of the first color non-image portion.

First, it operates the re-charging means 5. Next, the printing condition setting portion 20 controls the printing pattern so as to make both the first color printing and the second color printing at the non-exposing state. Namely, the printing condition setting portion 20 controls the printing pattern so as to become the blank printing for both the first color printing and the second color printing.

The surface potentiometer 13 detects the surface potential $Vn_1$ of the first color non-image portion.

To make the surface potential $Vn_1$ of the first color non-image portion equal to the target surface potential Vo after the re-charging, the corona current is adjusted with the set grid potential Vgi* (herein, i=1, 2 . . . , k means the setting point) and it the corona current Ici* that satisfies $Vn_1 = Vo$.

In the present invention, the condition regarding the surface potential $Vn_1$ of the first color non-image portion as stated above is called, hereinafter, the non-image portion re-charging condition for brevity purposes.

Figure 10:
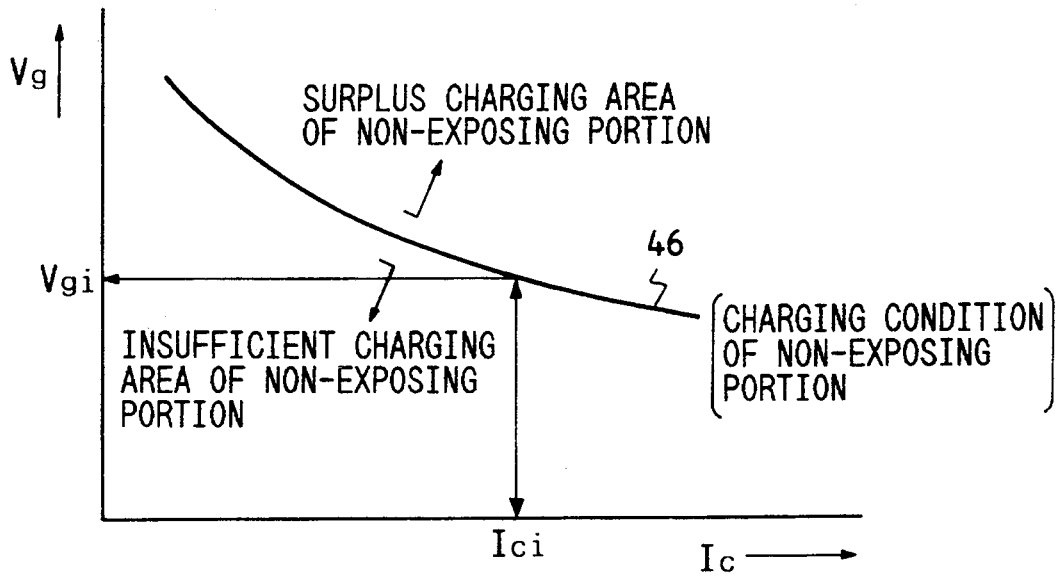
FIG. 10 is a graph showing the re-charging condition of a non-image portion.

The above stated processing operation is carried out repeatedly several times and the non-image portion re-charging condition as shown in FIG. 10 is requested and the requested non-image portion re-charging condition is stored in the memory in the printing condition setting portion In FIG. 10, a curve 46 satisfying the non-image portion re-charging condition is depicted. The curve 46 has an upper region and a lower region of which curve 46 is the boundary At the upper region of the curve 46, the non-image portion exhibits excessive charging and at the lower region of the curve 46 the non-image portion exhibits insufficient charging.

(3) The third step 3

Figure 9:
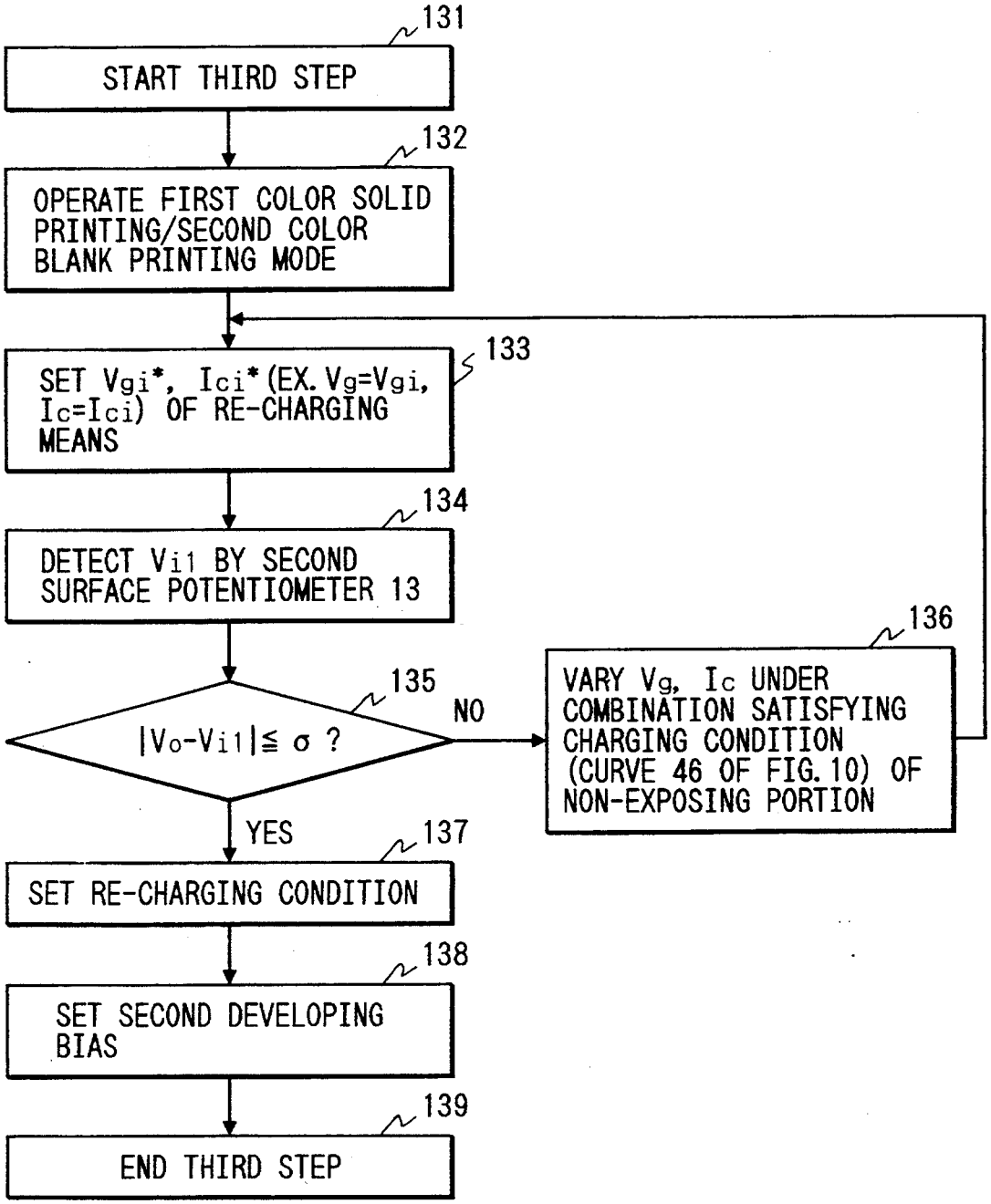
FIG. 9 is a flow-chart showing a third controlling procedure with respect to the re-charging control which is another feature of the embodiment shown in FIG. 1 according to the present invention.

As shown in FIG. 9, the third step comprises the steps from step 131 to step 139. This third step detects the surface potential $Vi_1$ of the first color toner image portion within the surface potential $Vn_2$ of the second color non-image portion after re-charging and controls the detected surface potential $Vi_1$ of the first color non-image portion.

First, it operates the re-charging means 5. Next, the printing condition setting portion 20 controls the printing pattern for both the first color and the second color at full exposing. Namely, the printing condition setting portion 20 controls the printing pattern so as to become solid printing for the first color printing and blank printing for the second color printing.

The surface potential $Vi_1$ of the first color toner image portion after re-charging is detected through the second surface potentiometer 13. According to the detected surface potential $Vi_1$ of the first color toner image portion, the difference in the surface potential $\Delta V$ (between the surface potential $Vi_1$ of the first color toner image portion after re-charging and the target surface potential Vo) is determined by selecting the re-charging condition having less than a predetermined value δ (50~100 (v)) within the non-image portion re-charging condition.

In other words, the potential difference ΔV between the surface potential $Vi_1$ of the first color toner image portion after the re-charging and the surface potential $Vn_1$ of the non-image portion of the first color the re-charging is determined by selecting the re-charging condition having less than the predetermined value δ (50~100 (v)) within the non-image portion re-charging condition.

Figure 11:
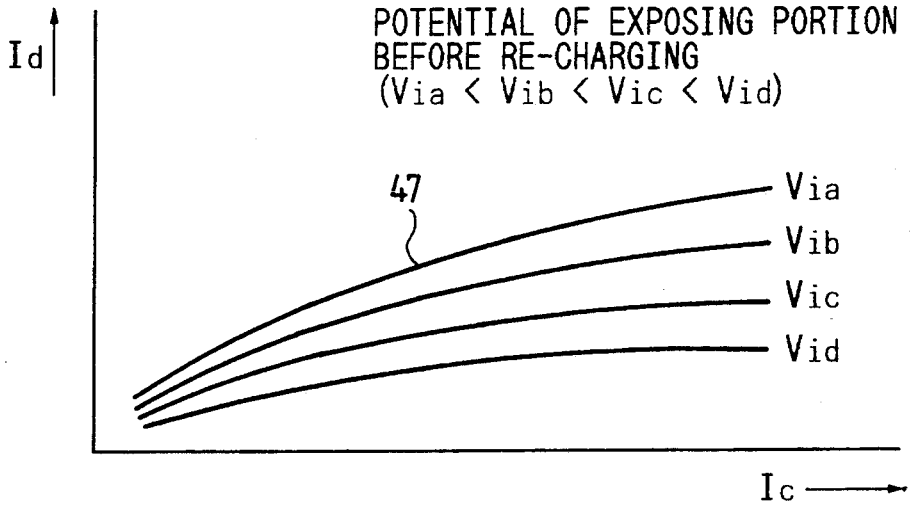
FIG. 11 is a graph showing the relationship between the corona current of a re-charging means and the current flowing into a photosensitive body.

FIG. 11 is a graph showing a relationship between the corona current Ic of the re-charging means 5 and the inflow current Id to the photosensitive body 1.

As shown in FIG. 11, when the surface potential Vi of the toner image portion before the re-charging is small, it is necessary to set the corona current Ic to be high so as to obtain a large inflow current Id.

However, since the inflow current Id receives the effect of the surface potential Vi of the toner image portion before re-charging, in proportion to an increase in surface potential Vi, the corona current Ic necessary to maintain a predetermined inflow current Id increases. Thereby, the inflow current is set based on the above stated conditions.

The re-charging condition determined by the above method is transmitted to the re-charging controlling portion 16 from the printing condition setting portion 20. The re-charging controlling portion 16 controls the output value of the corona discharging power source 14 and the output value of the grid power source 15 in accordance with the re-charging condition being input. The second color developing bias condition is controlled through the printing condition setting portion 20.

It is not necessary to always carry out the above stated control and setting of the first step, the second step and the third step. The above stated control and setting of the first step, the second step and the third step be performed during the warm up of the two-color recording apparatus, periodically or intermittently after the printing.

The above stated control of the first step, the second step and the third step is used during two-color printing. For monochrome printing of the second color, it is possible to prevent excessive charge and insufficient charge by selecting or setting the combination of the optional grid potential Vg and the optional corona current Ic within the non-exposing portion charging conditions.

According to this embodiment providing the re-charging controlling portion having the above stated functional means according to the present invention, even if the surface potential is changed in concert with change in the environmental conditions, a change in the surface state of the photosensitive body and a change in the dirty state of the charging means, it is possible to maintain less than the predetermined value. Therefore in this embodiment was the advantage that stable two-color printing quality is ensured for a long time.

Next, we shall herein explain the embodied example of the re-charging condition using the embodiment shown in FIG. 1 according to the present invention.

The photosensitive body 1 is a drum made of SeTe and the peripheral speed of the photosensitive body 1 is set at 300 mm/s. The re-charging means 5 is a scorotron type re-charging means having four discharging wires and having 50 mm in width.

The target surface potential Vo after the re-charging is set at about 700 (v), and the value $|Vo-Vg|=200$ (v) is set and the grid potential Vg is set at 470 (v).

The corona current Ic is set at 1200~1300 (μA) so as to have the surface potential $Vn_1$ of the non-image portion of the first color after the re-charging being 690~710 (v).

As a result, the surface potential $Vi_1$ of the toner image portion of the first color is increased from 100~130 (v) before re-charging to 630~650 (v) after re-charging and the potential difference ΔV between the surface potential $Vi_1$ of the first color toner image portion and the surface potential $Vn_1$ of the first color non-image portion is reduced about 50~70 (v).

The direct current component potential Vdc of the developing bias potential is set at 100 (v)$=|Vo-Vdc|$ so as to satisfy the above formula (1) or the above formula (1*a*). In this time, the developing gap in the developing station shown in FIG. 3 is set at 800 μm, and a gap of the doctor blade portion is set at 250 μm.

The peripheral speed of the developing sleeve 25 is set 1.1 times the peripheral speed of the photosensitive body 1 and the peripheral speed of the magnet roller 34 is set 3.1 times of the peripheral speed of the photosensitive body 1, respectively.

The alternating current of the developing bias is set at 2 (KVpp) at 1.5 KHz and the developing bias potential is overlapped on the direct current component potential Vdc of 600 (v).

As a result of the performance of the two-color printing under the above stated conditions, it can ensured the image density having 1.2 (optical density; O.D.) of the second color, it does not disturb the toner image of the first color, the second color toner more than 3% (occupied area ratio) does not mix into the toners of the first color. Therefore a sample material having the clear two-color printing can be obtained.

The above stated facts shows the following facts. Namely, the surface potential distribution of the photosensitive body 1 in each process becomes like FIG. 6 as explained before. And the surface potential $Vn_1$ of the non-image portion of the first color is left to remain at that target potential value Vo=700 (v) and the surface potential $Vi_1$ of the toner image portion of the first color is raised.

Since the surface potential $Vi_1$ of the first color toner image portion is made to be higher than the direct current component potential Vdc of the developing bias potential, the insurance of the image density is compatible with the prevention of the mixed colors.

In a case of $|Vo-Vdc|>200$ (v), it caused the problem that the image density of the second color becomes lower, the developing property of the small characters becomes insufficient and the carriers adhere to the non-image portion of the photosensitive body 1, which causes a dirty background (the non-image portion).

In a case of $|Vo-Vg|<150$ (v) and the target surface potential Vo being 700 (v), namely in a case of $|Vg|>0.8|Vo|$, the surface potential difference ΔV becomes more than about 100 (v), it tends to cause the toners of the second color having 7% (occupied area ratio) to mix into the toner image portion of the first color.

The inventors of the present invention have performed the experimentation in which the moving speed U of the photosensitive body 1 varies and the static-electro capacity of the photosensitive body 1 varies.

As a result, the inventors have reached and found out the re-charging conditions for making (less than 100 (v)) the surface potential difference ΔV after the small.

Namely, the re-charging conditions for making (less than 100 (v)) the surface potential difference ΔV small after the re-charging has the relationship as shown in following formula (4) between the electro-static capacity Cp (nf/mm$^2$) of the photosensitive body 1, the discharging current Is (μA) of the scorotron type re-charging means 5, the moving speed U (mm/sec) of the photosensitive body 1 and the discharging wire length Ls (mm) of the scorotron type re-charging means 5.

$$1 \leqq \{(Is/(U \cdot Ls \cdot Cp)\} \leqq 10 \quad (4)$$

Therefore, in accordance with the above stated relationship about the re-charging conditions for making the potential difference ΔV small after the re-charging using the above stated formula (4), even the case in which the characteristic of the photosensitive body 1 and the moving speed U of the photosensitive body 1 is varied, it can easily reset the optimum re-charging conditions.

Figure 12:
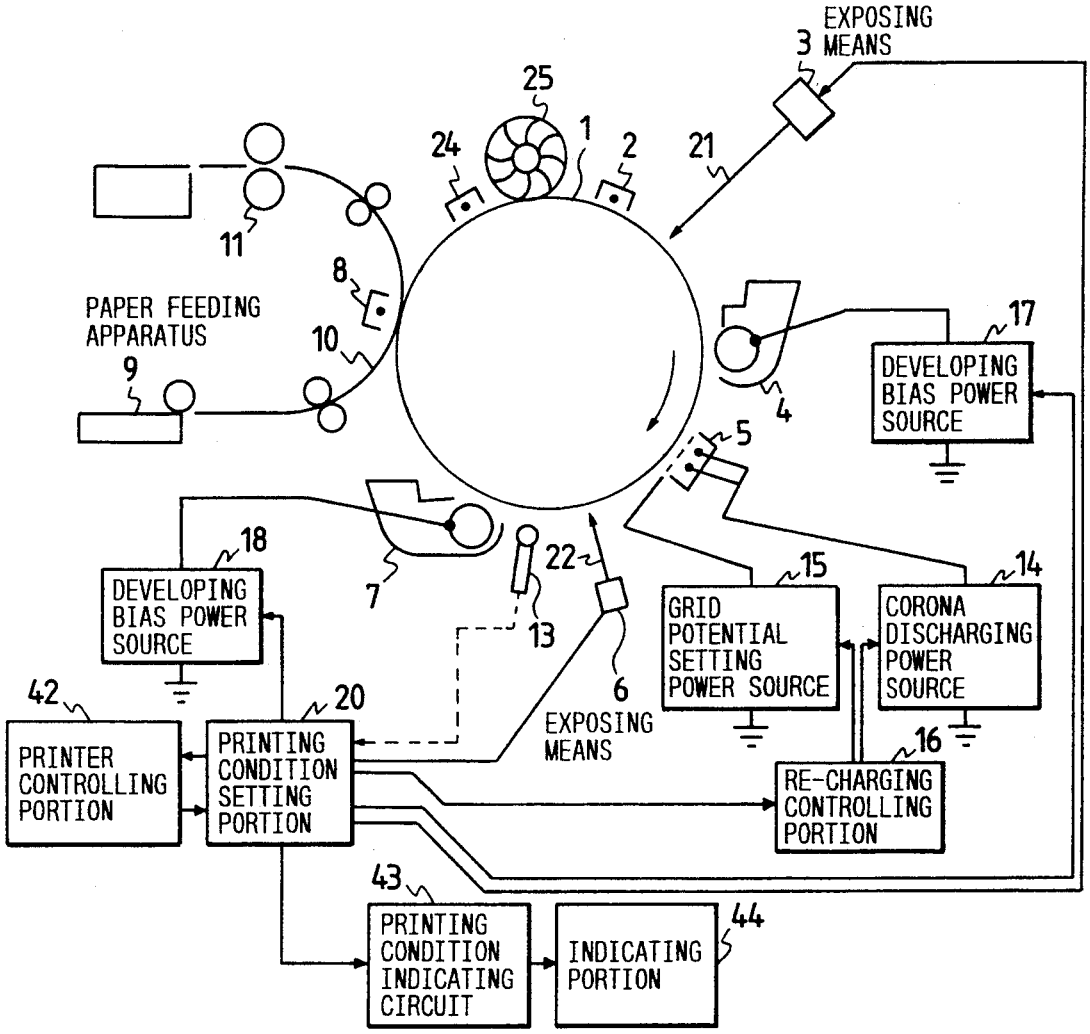
FIG. 12 is a schematic view showing another embodiment of a multi-color recording apparatus using an electro-photography process according to the present invention.

FIG. 12 shows another embodiment according to the present invention. The differences between the embodiment shown in FIG. 1 and this embodiment are (1) a printer controlling portion 42 is provided on the two-color recording apparatus, and in accordance with the command of the printer controlling portion 42 the printing condition setting portion 20 is operated, and 1(2) a printing condition indicating portion 43 and an indicating portion 44 are provided on the two-color recording apparatus.

The printer controlling portion 42 may be provided built-in or adjacent to the two-color recording apparatus. The printer controlling portion 42 may be provided separately so as to be controlled from a remote portion.

It is preferable to have a manual terminal in the printer controlling portion 42 for modifying the setting conditions of the re-charging conditions and the developing conditions by users, or to have a keyboard input circuit for modifying the setting conditions of the re-charging conditions and the developing conditions by users.

It is desirable to install within only one apparatus the printer controlling portion 42 and the indicating portion 42.

One can make one structure or two independent structures with the above stated differences (1) and (2).

According to this embodiment of the present invention, it has the following merits.

(a) When the re-charging condition exceeds a predetermined value, this embodiment can indicate the information about an error and the counter-measurement.

(b) In accordance with the indications with respect to the image quality of the printing sample and the re-charging condition and the printing condition, the users can select the image density about the first color, the second color, etc..

Figure 13:
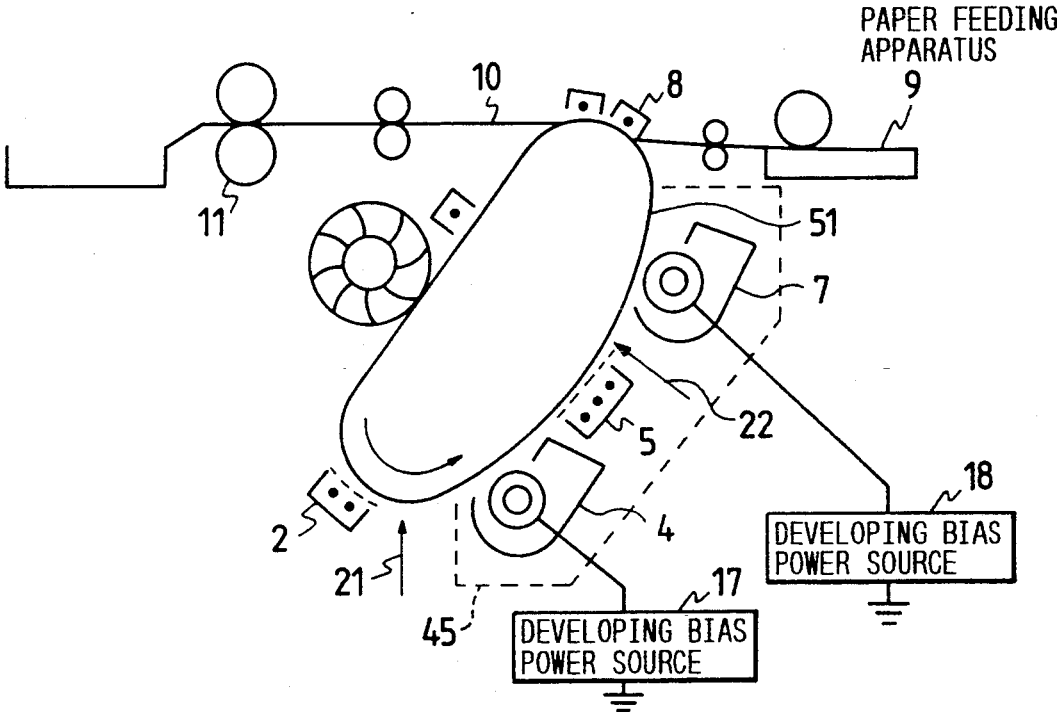
FIG. 13 is a schematic view showing a further embodiment of a multi-color recording apparatus using an electro-photography process according to the present invention.

FIG. 13 shows a further embodiment according to the present invention. The difference in the structure as compared to the embodiment shown in FIG. 1 are (3) a recording paper feeding passage is positioned in an upper portion, (4) a belt type photosensitive body 51 is employed as the photosensitive body, (5) the first color developing means 4, the re-charging means 5 and the second color developing means 7 are positioned on one side only (right half portion), respectively, and (6) the number of the discharging wires of the re-charging means 5 is larger than the number of the discharging wires of the first color charging means 2, etc..

According to the above stated embodiment of the present invention, it has the following merits corresponding to the above stated different structures.

(i) As the passage of the recording paper is positioned in the upper portion, in a case of the recording paper jam one can easily remove the recording paper.

(ii) By the employment of the belt type photosensitive body 51, one can have a curvature rate suitable for each component. For example, the curvature rate of the belt type photosensitive body 51 can be made small in the vicinity of the transferring means 8, since it make the peeling property of the recording paper, smooth thereby it can lessen the occurrence of a recording paper jam.

(iii) The constituting components from the first color developing means 4 to the second color developing means 7 are positioned on one side (right half portion side) and as the broken line shown in FIG. 13 it is possible to make it a single structure. One can easily perform the maintenance on the embodiment, such as the exchange of the developing agent or the cleaning of the re-charging means.

(iv) Since the number of the discharging wires of the re-charging means 5 has more than the number of the discharging wires of the first color charging means 2, the voltage applied to the discharging wires of the re-charging means 5 can be lowered and thereby it can prevent abnormal discharge from the discharging wires.

Besides, in the above stated embodiments, as the embodiment of the present invention it is exemplified that in the multi-color recording apparatus the two-color toner images are formed while the photosensitive body rotates at one rotation number.

However, the present invention may apply to a multi-color recording apparatus in which the two-color toner images are formed while the photosensitive body rotates at two rotation numbers, which is the two path and two-color printing method, similarly to the above stated embodiments.

Next, a further embodiment about the two path and two-color printing method according to the present invention will be explained referring to the construction shown in FIG. 1.

The six different points comprising from item (1) to item (6) in the method and apparatus of this embodiment in comparison with the method or the apparatus shown in FIG. 1 are as follows.

Item (1): One charging means 5 serves as a first charging and a second charging (re-charging).

Item (2): One exposing means 22 serves as a first exposing and a second exposing.

Item (3): At the first time rotation (the point of the photosensitive body 1 just before the charging means 5 is the starting point) the photosensitive body 1 operates the charging means 5 for charging the first charging, the exposing means 22 for exposing the first exposing and the first developing means 4, and the first color toner images are formed on the photosensitive body 1.

In this time, so as not to expel or disturb the first color electric latent images (surface potential distribution) on the photosensitive body 1 formed by the first charging and the first exposing, the following conditions are employed.

Namely, all of the second developing means 7, the transferring means 8, the surface potential erasing means 24 and the cleaning means 25 are in a the non-operable condition. All of the developing agent stored in the second developing means 7, the recording paper, the transferring means 8, the surface potential erasing means 24 and the cleaning means 25 are made to be in a non-contact condition with the photosensitive body 1.

Item (4): At the second time rotation the photosensitive body 1 operates the second charging means 5 for re-charging, the exposing means 22 for exposing the second exposing and the second developing means 7, and the second color toner images are formed on the photosensitive body 1 on which the first color toner images are held.

The two-color toner images formed on the photosensitive body 1 are transferred to the transported recording paper by the transferring means, and transferred toners are fixed by the fixing means.

The residual surface potential distribution and the residual non-transferred toners on the photosensitive body 1 are removed by the surface potential erasing means 24 and the cleaning means 25, respectively.

Further, so as not to adhere the first color toner images on the photosensitive body 1, the first developing means 4 controls the developing bias power source 17.

Item (5): This embodiment, for the first charging of the first time rotation, the controlling potential $Vg_1$ is set to be substantially the same as the target potential Vo and in a case of the second re-charging of the second time rotation the controlling potential $Vg_2$ is set lower than the target potential Vo, for example, $|Vg_2| \leqq 0.8|Vo|$.

Accordingly, in the case in which one charging means 5 serves as the first charging and the second charging (re-charging), the relationship between the controlling potential $Vg_1$ on the first charging time and the controlling potential $Vg_2$ on the second charging time is set to satisfy according to the following formula (5).

$$|Vg_2| \leqq 0.8|Vg_1| \quad (5)$$

Item (6): The surface state of the photosensitive body 1 varies due to the change in the environmental condition and the inferior in the photosensitive body 1, etc.

In the above case, it is necessary to increase or decrease the charging amount to the photosensitive body 1, and it is necessary to set the controlling potential $Vg_1$ of the first charging time with the different potential value against the charging target potential Vo.

In the above stated two cases in this embodiment, it is satisfy by the above stated formula (5).

The above embodiment of the present invention, has the following merits. (1) Since one charging means 5 serves as the first charging and the second charging (re-charging) and one exposing means 22 serves as the first exposing and the second exposing, the number of the image producing units can be lessened, accordingly the multi-color recording apparatus can be smaller. (2) In the re-charging process on the second time rotation of the photosensitive body 1, the potential difference between the surface potential of the non-image portion and the potential of the toner image portion formed on the before stage can be held to less than a predetermined value, therefore the mixed colors do not occur. (3) Even if the charging condition varies in concert with a change in the environment condition, a change in the surface state of the photosensitive body and a dirty state of the charging means etc., it is possible to hold the potential difference after the re-charging to than a predetermined value. Thus, the stable quality of the multi-color printing material can be maintained for a long time.

In this embodiment of the present invention, it has no process for erasing the surface potential of the photosensitive body 51, thereby it can adopt the monochrome printing apparatus. In this monochrome printing apparatus the charging process, the exposing process and the developing process are carried out repeatedly and the toner images are formed on the photosensitive body 51 and the image recording is carried out.

In this case, the relationship between the grid potential Vg (v) of the re-charging means 5, the surface potential Vn (v) of the non-image portion before the re-charging and the target surface potential Vo (v) after the re-charging is set as the above stated formula (2a), which is $0.8|Vo| \geqq |Vg| > |Vt|$, wherein Vt is the surface potential of the toner image portion just before the re-charging.

According to the above setting as shown in the above formula (5), since it can reduce the potential difference after the re-charging process between the toner image portion formed in the prior stage and the non-image portion formed in the prior stage on and after the second process, the occurrence of the overlapping image or the after image can be prevented.

According to the present invention, even the high speed multi-color printing is carried out using a small size re-charging means, in the re-charging process on and after the second color, the potential difference between the surface potential of the non-image portion and the surface potential of the toner image portion formed in the before stage is reduced, and it cannot cause the mixed colors.

Further, according to the present invention, even if the charging condition is changed in concert with a change in the environment condition, a change in the surface state of the photosensitive body and a dirty state of the charging means, it can maintain the potential difference after the re-charging at a predetermined value, and it can ensure the quality of the multi-color printing material for a long time.

We claim:

1. A method of multi-color recording using an electro-photography process comprising the steps of:

a) producing an image by the following steps:
   (i) charging a photosensitive body;
   (ii) exposing selectively a surface of said photosensitive body charged in step (i) in response to a desired recording content; and
   (iii) forming toner images by adhering toners to said surface of said photosensitive body exposed in step (ii);

b) transferring said toner images on said surface of said photosensitive body to a recording medium;

c) fixing said toners to said recording medium;

d) repeating step a) of producing to form toner images having several colors on said surface of said photosensitive body;

e) charging the photosensitive body with a charger having a control electrode during a second charging step and all successive charging steps; and f) applying a controlling potential (Vg) to the control electrode, wherein a relationship between the controlling potential (Vg), the target surface potential (Vo) of a non-image portion of said surface of said photosensitive body and a direct current component potential (Vdc) of a developing bias potential in each developing step satisfies the following formula, $$|Vo| > |Vdc| \geqq |Vg|$$

whereby mixing of colors during and after the second charging step can be prevented.

2. A method of multi-color recording using an electro-photography process comprising the steps of:

a) producing an image by the following steps:
   (i) charging a photosensitive body;
   (ii) exposing selectively a surface of said photosensitive body charges in step (i) in response to a desired recording content; and
   (iii) forming toner images by adhering toners to said surface of said photosensitive body exposed in step (ii);
b) transferring said toner images on said surface of said photosensitive body to a recording medium;
c) fixing said toner images to said recording medium;
d) repeating step a) of producing to form toner images having several colors on said surface of said photosensitive body;
e) charging the photosensitive body with a charger having a control electrode during a second charging step and all subsequent charging steps
f) applying a controlling potential (Vg) to said control electrode of said charger, wherein a relationship between the controlling potential (Vg) and a target surface potential (Vo) of a non-image portion of said photosensitive body satisfies the following formula, $$0.8|Vo| \geqq |Vg|$$

whereby mixing of colors during and after the second charging step can be prevented.

3. The method according to claim 1, wherein the controlling potential (Vg) has an absolute value |Vg| that is higher than an absolute value |Vt| of a surface potential of a toner image portion of said surface of said photosensitive body before the second charging step.

4. An apparatus for multi-color recording using an electro-photography process comprising;

a) an endless type rotatable photosensitive body;
b) a plurality of image producing units disposed successively along an exterior of said photosensitive body, each of said plurality of image producing units including:
   (i) a charger charging electric charges on the photosensitive body, and having a control electrode for controlling a discharge current;
   (ii) an exposing means for forming electro-static latent images by selectively exposing the electric charges charged by said charger on the surface of the photosensitive body according to a desired recording content; and
   (iii) a developing means for forming toner images by adhering toners on the electro-static latent images formed by said exposing means;
c) a transferring means being disposed adjacent to said surface of said photosensitive body at a rear side of a last visit of said plurality of image producing units, and said transferring means transferring toner images on said surface of said photosensitive body to a recording medium;
d) a fixing means being disposed adjacent to said surface of said photosensitive body at the rear side of the last visit of said plurality of image producing units, and said fixing means fixing toners to said recording medium, wherein a relationship between a controlling potential (Vg) applied to said control electrode, a target surface potential (Vo) of a non-image portion of said photosensitive body and a direct current component potential (Vdc) of a developing bias potential during each developing process is satisfied by a following formula, $$|Vo| > |Vdc| \geqq |Vg|$$

whereby mixing of colors during a second charging process and during all subsequent charging processes can be prevented.

5. An apparatus for multi-color recording using an electrophotography process comprising:

a) an endless type rotatable photosensitive body;
b) a plurality of image producing units disposed successively along an exterior of said photosensitive body, each of said plurality of image producing units including:
   (i) a charger charging electric charges on the photosensitive body, and having a control electrode for controlling a discharge current;
   (ii) an exposing means for forming electro-static latent images by selectively exposing the electric charges charged by said charger on the surface of the photosensitive body according to a desired recording content; and
   (iii) a developing means for forming toner images by adhering toners on the electro-static latent images formed by said exposing means;
c) a transferring means being disposed adjacent to said surface of said photosensitive body at a rear side of a last visit of said plurality of image producing units, and said transferring means transferring toner images on said surface of said photosensitive body to a recording medium; and
d) a fixing means being disposed in correspondence to said surface of said photosensitive body at the rear side of the last visit of said plurality of image producing units, and said fixing means fixing said toners to said recording medium, wherein a relationship between a controlling potential (Vg) applied to said controlling electrode and a target surface potential (Vo) of a non-image portion of said surface of said photosensitive body is satisfied by the following formula, $$0.8|Vo| \geqq |Vg|$$

whereby mixing of colors during a second charging process and during all subsequent charging processes can be prevented.

6. The apparatus according to claim 4, wherein the developing means has a developing bias with an alternating current component and a direct current offset.

7. The apparatus according to claim 4, wherein an absolute value |Vg| of the controlling potential applied to said controlling electrode is set higher than an absolute value |Vt| of a surface potential of a toner image portion of said surface of said photosensitive body before a second charging process.

8. An apparatus for multi-color recording using an electro-photography process comprising:

a) an endless type rotatable photosensitive body;

b) a plurality of image producing units being disposed successively along an exterior of said photosensitive body, each of said plurality of image producing units including:
(i) a charger charging electric charges on the photosensitive body, and having a control electrode for controlling a discharge current;
(ii) an exposing means for forming electro-static latent images by selectively exposing the electric charges charged by said charger on the surface of the photosensitive body according to a desired recording content; and
(iii) a developing means for forming toner images by adhering toners on the electro-static latent images formed by said exposing means;
c) a transferring means disposed adjacent to said surface of said photosensitive body of a rear side of a last visit of said plurality of image forming units, and said transferring means transferring said toner images on said surface of said photosensitive body to a recording medium; and
d) a fixing means disposed in correspondence to said surface of said photosensitive body of the rear side of the last visit of said plurality of image producing units and said fixing means fixing said toners to said recording medium;
e) a potential detector detecting surface potentials of a toner image portion and a non-image portion of said surface of said photosensitive body sent from a second image producing unit and all subsequent image producing units of said plurality of image producing units;
f) a memory storing a formula describing a relationship between a controlling potential and a discharging current of the charger from the second image producing unit and all subsequent image producing units; and
g) a controller setting the controlling potential and the discharging current of the second image producing unit and all subsequent image producing units of the plurality of image producing units in accordance with the surface potentials of said toner image portion and said non-image portion of said surface of said surface of said photosensitive body detected by the potential detector and the formula stored in the memory,

9. The apparatus according to claim 4, wherein a relationship between an electro-static capacity (Cp) ($nf/mm^2$) of said photosensitive body, the discharging current (Is) ($\mu A$) of said charger from the second image producing unit and all subsequent image producing units, a moving speed (U) (mm/sec) of said photosensitive body, and a discharging wire length (Ls) (mm) of said charger from the second image producing unit and all subsequent image producing units is set according to the following formula, $$1 \leqq \{Is/(U \cdot Ls \cdot Cp)\} \leqq 10$$

whereby mixing of colors during the second charging process and all subsequent charging processes can be prevented.

10. In an apparatus for color recording an electrophotographic recording in which without erasing a surface potential of a photosensitive body, a charging process, an exposing process and a developing process are carried out repeatedly, and toner images are formed on a surface of the photosensitive body a charger for charging electric charges on the surface of the photosensitive body comprising:
a control electrode receiving a control potential, wherein a relationship between the controlling potential (Vg) applied to said control electrode after a second image producing stage, a surface potential (Vt) of a toner image portion of said surface of said photosensitive body from a prior image producing stage and a target surface potential (Vo) of a non-image portion of said surface of said photosensitive body after charging by said charger is satisfied by a following formula $$0.8|Vo| \geqq |Vg| > |Vt|$$

11. A method for multi-color recording using an electro-photography process comprising the following steps;
a) producing an image according to the following steps:
(i) charging a photosensitive body using a charger with a control electrode;
(ii) exposing selectively a surface of the photosensitive body after the photosensitive body is charged in response to a desired recording content; and
(iii) developing toner images by adhering toners to said surface of said photosensitive body after the photosensitive body is exposed;
b) repeating said step a) of producing once every rotation of said photosensitive body;
c) forming toner images having multiple colors on the surface of the photosensitive body;
d) reducing a controlling potential applied to the control electrode of the charger during a second rotation of the photosensitive body and during all subsequent rotations of the photosensitive body from what the controlling potential was during a first rotation of said photosensitive body.

12. A method for multi-color recording using an electro-photography process comprising the steps of:
a) producing an image by the following steps:
(i) charging a photosensitive body using a charger with a control electrode;
(ii) exposing selectively a surface of the charged photosensitive body after the photosensitive body has been charged in response to a desired recording content; and
(iii) developing toner imaged by adhering toners to said surface of the photosensitive body after the photosensitive body has been exposed;
b) repeating step a) of producing once every rotation of the photosensitive body;
c) forming toner images having several colors on said surface of said photosensitive body;
d) applying a second controlling potential $VF_2$ to the control electrode of the charger during a second rotation of the photosensitive body and during all subsequent rotations of the photosensitive body that is lower than a first controlling potential $Vg_1$ applied to the control electrode during a first rotation of said photosensitive body according to the following formula $$|Vg_2| \leqq 0.8|Vg_1|.$$

* * * * *

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

On the title page, item [57]:

IN THE ABSTRACT: Line 5: Change "charming" to --charging--.
Line 10: Change "ia" to --is--.
Line 11: Change "rise" to --raise--.
Line 13: Change "re-charming" to --re-charging--.
Line 17: After "becomes" delete "to".
Line 19: Change "from mixing the" to --the mixing of--.
Line 20: Change "color" to --colors--.

| Column | Line | |
|---|---|---|
| 1 | 8 | Change "method" to --methods--. |
| 1 | 23 | After "medium" insert --,--. |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 2 | 11 | Change "is" to --are--. |
| 2 | 34 | Delete "uniformly". |
| 2 | 41 | Change "this" to --current--. |
| 2 | 56 | Delete "it become". |
| 2 | 57 | Delete "short". |
| 2 | 64 | Delete "before". |
| 3 | 12 | After "prior" delete "before". |
| 3 | 20 | Delete "the" (second occurrence); change "about" to --effecting--. |
| 3 | 28 | Delete "such". |
| 3 | 47 | Change "electric" to --current--. |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 3 | 50 | After "Accordingly" delete "that". |
| 3 | 53 | After "causes" delete "the". |
| 4 | 14 | After "comprises" insert --:--. |
| 4 | 46 | Delete "a". |
| 4 | 60 | After "exposing" insert --means--. |
| 4 | 61 | Change "expose selectively" to --selective exposure of--. |
| 5 | 6 | After "each" insert --of--. |
| 5 | 6-7 | Change "process" to --processes--. |
| 5 | 56 | After "each" insert --of--. |
| 5 | 57 | Change "process" to --processes--. |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 6 | 30 | After "have" insert --been--. |
| 7 | 6 | Change "it makes" to --makes it--. |
| 7 | 31 | After "color" insert --,--. |
| 7 | 37 | Change "the large" to --large.--. |
| 7 | 58 | Change "Ic and," to --Ic, and--. |
| 8 | 22 | Change "0.8 \|Vo\|" to --0.8 • \|Vo\|--. |
| 8 | 44 | Change "0.8 \|Vo\|" to --0.8 • \|Vo\|--. |
| 11 | 13 | Change "particularly" to --particular--. |
| 11 | 20 | Change "0.8 \|Vo\|" to --0.8 • \|Vo\|--. |
| 11 | 31 | After "since" delete "to". |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 11 | 48 | After "concert" insert --with--. |
| 11 | 64 | Change "Smaller than" to --As--. |
| 12 | 10 | After "contacts" delete "to". |
| 12 | 36 | Change "under the" to --in--; change "about" to --of--. |
| 13 | 30 | Change "as far" to --far as--. |
| 14 | 23 | After "k" insert --and it--. |
| 14 | 24 | Delete "and it". |
| 15 | 6 | After "first color" insert --after--. |
| 15 | 40 | After "step" insert --can--. |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 16 | 2 | Change "=200" to -- ≠200--. |
| 16 | 16 | Change "100 (v)=\|Vo-Vdc\|" to --100 (v)≠ \|Vo-Vdc\|--. |
| 16 | 31 | Change "can ensured" to --can be ensured that--. |
| 16 | 33 | Change "color, it does" to --color does--. |
| 16 | 34 | After "color" insert --that--; after "toner" insert --of--. |
| 16 | 44 | Change "Vo=700(v)" to --Vo ≠ 700(v)--. |
| 16 | 60 | Change "0.8 \|Vo\|" to --0.8 • \|Vo\|--. |
| 16 | 66 | After "formed" delete "the". |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 17 | 3 | Before "small" insert --re-charging--. |
| 17 | 29 | After "and" delete "1". |
| 18 | 8 | After "jam" insert --,--. |
| 18 | 14 | After "paper" delete ","; after "smooth" insert --,--. |
| 18 | 15 | Before "thereby" insert --and--. |
| 19 | 1 | After "are" insert --made to be--; after "a" delete "the". |
| 19 | 30 | Change "0.8 \|Vo\|" to --0.8 • \|Vo\|--. |
| 19 | 43 | Change "inferior" to --interior--. |

UNITED STATES PATENT AND TRADEMARK OFFICE

CERTIFICATE OF CORRECTION

PATENT NO. : 5,365,325

DATED : 15 November 1994

INVENTOR(S) : Takao KUMASAKA et al

It is certified that error appears in the above-identified patent and that said Letters Patent is hereby corrected as shown below:

| Column | Line | |
|---|---|---|
| 19 | 50 | Change "satisfy" to --satisfied--. |
| 22 | 52 | Change "0.8 \|Vo\|" to --0.8 • \|Vo\|--. |
| 24 | 14 | Change "0.8 \|Vo\|" to --0.8 • \|Vo\|--. |

Signed and Sealed this

Twenty-second Day of August, 1995

*Attest:*

*Attesting Officer*

BRUCE LEHMAN

*Commissioner of Patents and Trademarks*